US008943972B1

(12) United States Patent
Al-Shehab et al.

(10) Patent No.: US 8,943,972 B1
(45) Date of Patent: Feb. 3, 2015

(54) LINER RELEASE MECHANISM FOR ANTI-ARMOR MUNITIONS

(75) Inventors: Nausheen Al-Shehab, Paramus, NJ (US); Bruce D. Williamson, Andover, NJ (US); Ernest L. Baker, Wantage, NJ (US); David Pfau, Somerset, NJ (US); Adam J. Enea, Upper Montclair, NJ (US); David Hunter, Crestview, FL (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/602,865

(22) Filed: Sep. 4, 2012

Related U.S. Application Data

(60) Provisional application No. 61/543,862, filed on Oct. 6, 2011.

(51) Int. Cl.
*F42B 12/10* (2006.01)

(52) U.S. Cl.
CPC ..... *F24B 12/207* (2013.01); *F42B 12/10* (2013.01)
USPC ..... 102/481; 102/476

(58) Field of Classification Search
CPC ..... F42B 12/04; F42B 12/10; F42B 12/16; F42B 12/18; F42B 12/207; F42B 23/04; F42B 39/14; F42B 39/20; F02K 9/38
USPC ..... 102/305, 306, 331, 475, 476, 481, 307, 102/308, 310
See application file for complete search history.

(56) References Cited

U.S. PATENT DOCUMENTS

| | | | | | |
|---|---|---|---|---|---|
| 2,419,414 | A * | 4/1947 | Mohaupt | 102/476 |
| 2,927,535 | A * | 3/1960 | Abramson et al. | 244/3.1 |
| 4,703,695 | A * | 11/1987 | Langer | 102/476 |
| 4,938,146 | A * | 7/1990 | Gunther et al. | 102/439 |
| 4,945,835 | A * | 8/1990 | Gunter et al. | 102/476 |
| 5,035,181 | A * | 7/1991 | Jacks et al. | 102/481 |
| 5,237,929 | A * | 8/1993 | Ekholm | 102/476 |
| H1504 | H * | 12/1995 | Crabtree | 102/476 |
| 6,453,817 | B1 * | 9/2002 | Markel et al. | 102/306 |
| 6,752,085 | B2 * | 6/2004 | Roach | 102/481 |
| 7,150,231 | B2 * | 12/2006 | Olofsson | 102/481 |
| 7,331,292 | B1 * | 2/2008 | Kim et al. | 102/481 |
| 8,505,458 | B1 * | 8/2013 | Cannon | 102/481 |

* cited by examiner

*Primary Examiner* — James S Bergin
(74) *Attorney, Agent, or Firm* — Henry S. Goldfine

(57) ABSTRACT

An Insensitive Munitions safety device mitigates the occurrence of a violent response of an anti-armor munition subjected to elevated temperatures. The anti-armor munition includes a projectile body having fore and aft ends, an explosive charge disposed in the projectile body, and a projectile-forming or jet-forming liner disposed in the projectile body. The liner includes an aft surface contiguous with the explosive charge and a fore surface that defines a void. A liner restraint abuts a fore end of the liner and restrains movement of the liner. A portion of the liner restraint comprises a material having a heat deflection temperature less than the critical temperature of the explosive charge in the munition.

8 Claims, 1 Drawing Sheet

Fig. 1
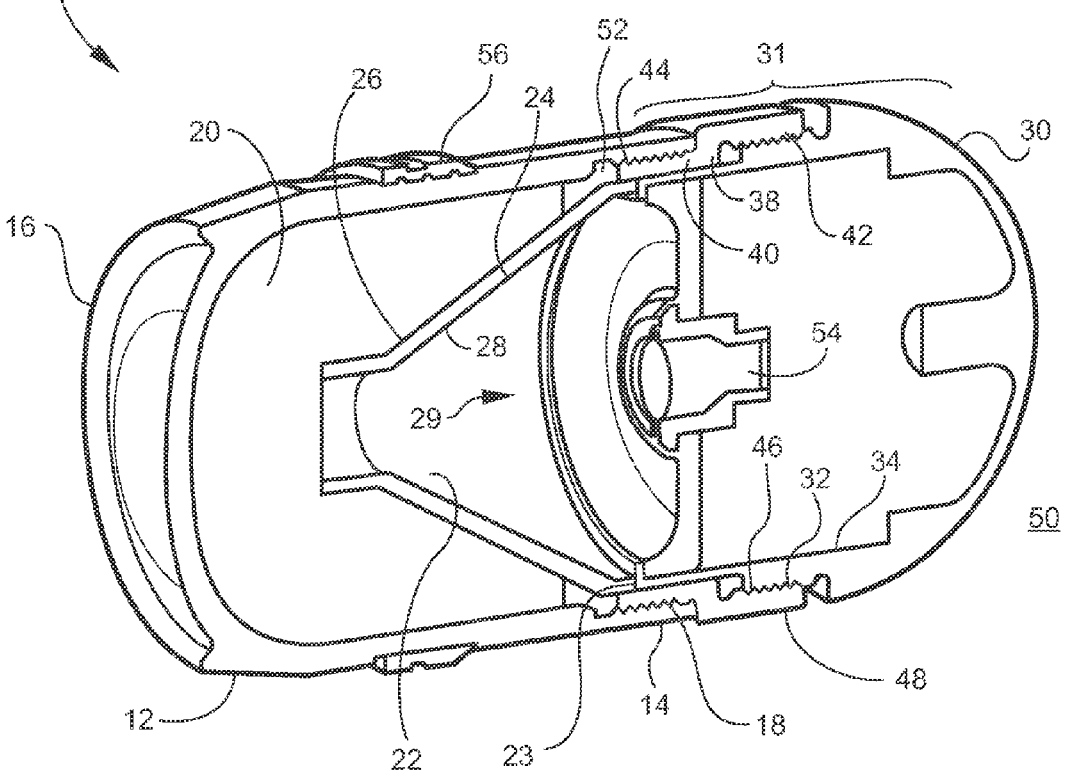
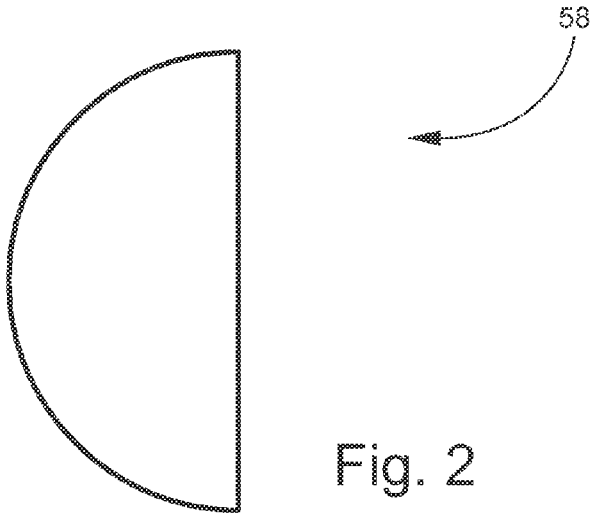
Fig. 2

LINER RELEASE MECHANISM FOR ANTI-ARMOR MUNITIONS

CROSS-REFERENCE TO RELATED APPLICATIONS

The present application claims the benefit of priority of U.S. provisional patent application Ser. No. 61/543,862 filed on Oct. 6, 2011, which is incorporated by reference herein.

STATEMENT OF GOVERNMENT INTEREST

The invention described herein may be manufactured, used and licensed by or for the United States Government.

BACKGROUND OF THE INVENTION

The invention relates in general to lined anti-armor munitions, such as shaped charges and explosively formed projectiles (penetrators), and in particular to anti-armor munitions that comply with insensitive munitions standards.

Since the invention of gunpowder and explosives and their application to the conduct of war, the prevention of accidental explosions has been a priority for armed forces concerned with preserving their own safety while handling munitions. This concern is heightened when munitions are subjected to various threat stimuli encountered during their lifecycle. Munitions that do not detonate when subjected to these threat stimuli are known as insensitive munitions (IM).

There is a need in the art of munitions design to improve munition response to IM threats, such as fast cook-off, slow cook-off, bullet impact, fragment impact, and sympathetic reaction, as established by MIL-STD-2105, "Military Standard for Hazard Assessment Tests for Non-Nuclear Munitions". Fast Cook-Off (FCO) refers to the condition in which the munitions are completely engulfed by the flame from a liquid fueled fire of at least 1,600 degrees Fahrenheit average temperature until a reaction occurs. Slow Cook-Off (SCO) refers to the condition in which the temperature surrounding the munitions is raised at the constant rate of 6 degrees Fahrenheit per hour until a reaction occurs. These tests are meant to replicate accidental exposure to similar conditions in the theatre of war and supporting logistics.

Several methods have been employed in the past to augment or improve various armaments' insensitive munitions performance. While some methods have been developed for application to bombs and warheads, the majority of the prior art includes safety devices for rockets. Of these prior examples, some safety devices rely on purposely creating weakened portions of the casing so that the casing will fail at a predetermined pressure below the pressure at which the explosive material will detonate. But, even though the explosive material does not detonate, the failure of the casing may allow the high pressure in the casing to propel or project damaging fragments outside of the casing.

Other safety devices are activated by a rise in ambient temperature near the warhead. These safety devices typically feature a meltable linkage at the juncture of adjacent sections of the munitions or vent holes covered by a meltable material, both of which are designed to melt at a temperature below the auto-ignition temperature of the explosive material and allow for release of the built-up pressure and evacuation of the products of combustion.

The aforementioned devices are generally complicated in nature and introduce a plurality of related components which present an increased risk of failure of the devices and high production costs associated with the manufacture and complicated assembly methods of the devices. Furthermore, these systems typically require significant redesign of current warhead casings.

A need exists for safety devices for shaped charged munitions and explosively formed projectiles that can achieve improved IM performance without significant negative impacts on functional performance or lifecycle cost.

SUMMARY OF THE INVENTION

One aspect of the invention is an anti-armor munition. The anti-armor munition includes a projectile body with fore and aft ends. An explosive charge is disposed in the projectile body. Either a jet-forming liner or a projectile-forming liner is disposed in the projectile body. The liner includes an aft surface contiguous with the explosive charge and a fore surface that defines a void. A liner restraint abuts a fore end of the liner and restrains movement of the liner. At least a portion of the liner restraint comprises a material having a heat deflection temperature less than a critical temperature of the explosive charge in the projectile body.

The projectile body may be generally cylindrical. The liner restraint may include a projectile nose having a cylindrical portion that extends interior to the fore end of the projectile body and that abuts and restrains the liner. The liner restraint may further include an adapter having first and second portions with the first portion being disposed between the fore end of the projectile body and the cylindrical portion of the projectile nose. The second portion may extend radially outwardly from the first portion and longitudinally away from the fore end of the projectile body to form a collar that abuts the fore end of the projectile body and abuts the cylindrical portion of the projectile nose.

The adapter may be the portion of the liner restraint that comprises the material having the heat deflection temperature less than the critical temperature of the explosive charge in the projectile body.

Another aspect of the invention is a method of mitigating the occurrence of a violent response of an anti-armor munition subjected to elevated temperatures. The method includes providing an anti-armor munition having one of a jet-forming and projectile-forming liner and an explosive charge therein. The liner is positionally restrained in the munition using an apparatus having at least a portion comprised of a material with a heat deflection temperature less than a critical temperature of the explosive charge in the munition.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1 is a cutaway perspective view of one embodiment of a shaped charge munition with a liner release mechanism.

FIG. 2 is a side view of an embodiment of a projectile-forming liner used in an explosively formed projectile munition.

DETAILED DESCRIPTION

Anti-armor munitions include shaped charges and explosively formed projectiles. Liners are used in shaped charges and explosively formed projectiles to form a high-speed jet or projectile. To mitigate the occurrence of an undesired violent response in an anti-armor munition that is subjected to elevated temperatures, for example, FCO and SCO, the structure in the munition that normally provides positional restraint for the liner can be removed. Removal of the liner's normal positional restraint allows the liner to separate from the explosive load. Separation of the liner from the explosive load enables depressurization of the high explosive billet. Depressurization of the high explosive billet delays the onset of and diminishes the violence of any subsequent reaction.

A material that softens and flows at elevated temperatures (less than the critical temperature of the high explosive billet) and that retains the necessary strength properties in the various operational environments of the munition may be employed either directly or indirectly in an anti-armor munition to remove the liner's normal positional restraint. The operational environments of the munition may include launch from a gun with the attendant setback acceleration, set forward acceleration, and spin. In some cases, the setback acceleration may be up to or greater than tens of thousands of time the acceleration of gravity on Earth.

Moving the liner also creates a pathway for the evacuation of the products of combustion emanating from the explosive load. The pathway for the evacuated products may lead to a larger chamber in the munition or to the exterior of the munition. In one embodiment, moving the liner may include separating a spitback initiator from the rest of the munition so that accidental functioning of the detonator is less likely to initiate detonation within the main charge, thereby precluding the formation of a highly lethal projectile or jet. By removing the potential for accidental formation of the projectile or jet, the risk of accidental detonation of nearby munitions is favorably reduced as well.

Embodiments of the present invention can be incorporated into the design and manufacture of existing encased shaped charge explosive munitions and explosively formed projectiles. The inventive technique is preferable over prior art solutions due to its inherent simplicity and ease of assembly with the other components of the warhead. Test results indicate that the present invention consistently exhibits a favorable Type V response (burning reaction) to both FCO and SCO threat stimuli in anti-armor munitions.

In some embodiments of the invention, the IM safety device forms a portion of the body of the munition. The IM safety device may join two sections of the munition body. Some or all of the IM safety device is made of a material having a heat deflection temperature less than the critical temperature of the explosive configuration in the munition. The heat deflection temperature of the material in the IM safety device is determined according to the procedure in ASTM D468 at a load of 0.46 MPa. The determination of the critical temperature of the explosive configuration is a type of thermal stability testing and is defined as the lowest constant surface temperature at which a given material of a specific shape and size will catastrophically self-heat causing a runaway reaction. Following ASTM E698 (or MIL-STD-1751), experimental data obtained from a Differential Scanning calorimeter (DSC) is used to determine various kinetic parameters associated with a given chemical reaction or decomposition, known as Arrhenius kinetic constants. This information is then used to calculate the critical temperature using the Frank-Kamenetski (F-K) equation. See, for example, Rogers, R. N., Thermochimica Acta, Vol. 11 (1975), p. 11.

The material of the IM safety device that has a heat deflection temperature less than the explosive's critical temperature must also possess the strength properties necessary for maintaining the integrity of the munition so that it will reliably perform its basic function. Either alone or in combination with other components of the munition, the IM safety device must provide restraint against movement of the munition's liner during transportation, storage, firing, launch, aeroballistic flight, and terminal interaction with the target. The IM safety device may either engage the munition's liner directly or otherwise provide the means necessary for other munition components to restrain the liner, thereby providing the required restraint against movement during all aspects of the munition's lifecycle.

In some embodiments of the invention, the liner is oriented with its main central axis directed away from the central longitudinal axis of the munition. Such side or top-attack anti-armor munitions perform a function other than frontal attack in the direction of the projectile's trajectory. In these side or top-attack munitions, the IM safety device provides positional restraint for the liner, either directly or indirectly, as well as positional restraint for the portion of the body of the munition that is adjacent to the liner. The IM safety device itself may also form a portion of the body of the munition that is adjacent to the liner. Regardless of the orientation of the IM safety device with respect to the axis of the munition, all or a part of it must be made of a material having the aforementioned thermal and strength properties.

FIG. 1 shows one embodiment of a shaped charge munition 10. Munition 10 includes a projectile body 12 having fore and aft ends 14, 16, respectively. An explosive charge 20 is disposed in projectile body 12. A shaped charge liner 22 is disposed in projectile body 12. Shaped charge liner 22 includes a generally conical portion 24 that increases in diameter in the direction toward the fore end 14 of projectile body 12. Increasing diameter portion 24 includes an aft surface 26 contiguous with explosive charge 20 and a fore surface 28 that defines a void 29. As is known in the art, the liner 58 (FIG. 2) of an explosively formed projectile is generally in the shape of a sector of a sphere, rather than conical as portion 24. Even so, the invention is applicable to explosively formed projectiles.

A shaped charge liner restraint 31 abuts a fore end 23 of shaped charge liner 22 and restrains movement of shaped charge liner 22. At least a portion of shaped charge liner restraint 31 is made of a material having a heat deflection temperature (per ASTM D468 at a load of 0.46 MPa) less than the critical temperature of explosive charge 20 in projectile body 12.

Projectile body 12 is generally cylindrical and fore end 14 of projectile body 12 includes internal threads 18. In the embodiment shown, shaped charge liner restraint 31 includes a projectile nose 30 having a cylindrical portion 34 that extends interior to fore end 14 of projectile body 12. Cylindrical portion 34 abuts and restrains shaped charge liner 22. Cylindrical portion 34 includes external threads 32 thereon. Restraint 31 includes an adapter 38 having first and second portions 40, 42, respectively. First portion 40 is inserted between fore end 14 of projectile body 12 and cylindrical portion 34 of projectile nose 30. First portion 40 has external threads 44 that engage internal threads 18 of fore end 14 of projectile body 12. Second portion 42 has internal threads 46 that engage external threads 32 of projectile nose 30. Second portion 42 extends radially outwardly from first portion 40 and longitudinally away from fore end 14 of projectile body 12 to form a collar 48 that abuts fore end 14 of projectile body 12 and abuts cylindrical portion 34 of projectile nose 30.

In the embodiment shown, adapter 38 is the portion of shaped charge liner restraint 31 that is made of a material having a heat deflection temperature less than the critical temperature of explosive charge 20 in projectile body 12.

Exemplary materials for adapter 38 include, but are not limited to, eutectic metals and synthetic or organic thermoplastic polymers. The thermoplastic polymers may be reinforced with glass or other crystalline particles.

Especially in the case where munition 10 is gun-launched, adapter 38 forms a gas seal between the exterior 50 and the interior 52 of shaped charge munition 10 to prevent gun propellant gases from entering munition 10. When gun-launched, munition 10 can be subject to 45,000 g's or more of setback acceleration. To impart spin to munition 10, an obturating band 56 may be disposed on projectile body 12. In some embodiments, an initiator 54 is disposed in projectile nose 30. Initiator 54 may be, for example, a spitback initiator that is disposed adjacent void 29 defined by liner 22. In other embodiments (not shown), an initiator 54 may be disposed adjacent the aft end of explosive charge 20.

As munition 10 is heated in a cook-off environment, threaded adapter 38 begins to soften at a temperature below the critical temperature of explosive charge 20 in munition 10. In its weakened state, threaded adapter 38 can no longer support projectile nose 30. Thus, nose 30 falls away from projectile body 12. Without the normal restraint 31 provided by the other components of munition 10, shaped charge liner 22 is released from explosive charge 20. As liner 22 is pushed further away from explosive charge 20, gases produced from the decomposition of explosive charge 20 exit out fore end 14 of projectile body 12. In the resulting unconfined state, explosive charge 20 is less likely to react violently to the thermal threat stimuli, thereby providing favorable insensitive munitions performance. A particular advantage of the embodiment shown in FIG. 1 is that, as liner 22 is pushed away from charge 20, initiator 54 is also pushed away from charge 20, thereby decreasing the risk that accidental functioning of initiator 54 will detonate charge 20.

The details, materials, steps and arrangement of parts have been described and illustrated to explain the nature of the invention. It will be understood that many changes in the details, materials, steps and arrangement of parts may be made by those skilled in the art, within the principle and scope of the invention, as expressed in the appended claims and equivalents thereof.

What is claimed is:

1. An anti-armor munition, comprising:

a projectile body having fore and aft ends;

an explosive charge disposed in the projectile body;

one of a jet-forming liner disposed in the projectile body, the liner including an aft surface contiguous with the explosive charge and a fore surface that defines a void; and a liner restraint that abuts a fore end of the liner and restrains movement of the liner wherein at least a portion of the liner restraint comprises a material having a heat deflection temperature less than a critical temperature of the explosive charge in the projectile body;

wherein, said liner restraint includes a projectile nose having a cylindrical portion that extends interior to the fore end of the projectile body and that abuts and restrains the liner; and an adapter having first and second portions, the first portion being disposed between the fore end of the projectile body and the cylindrical portion of the projectile nose, the second portion extending radially outwardly from the first portion and longitudinally away from the fore end of the projectile body to form a collar that abuts the fore end of the projectile body and abuts the cylindrical portion of the projectile nose.

2. The munition of claim 1, wherein the adapter is the portion of the liner restraint that comprises the material having the heat deflection temperature less than the critical temperature of the explosive charge in the projectile body.

3. The munition of claim 2, wherein the fore end of the projectile body includes internal threads, the cylindrical portion of the projectile nose includes external threads, the first portion of the adapter includes external threads that engage the internal threads of the fore end of the projectile body, and the second portion of the adapter includes internal threads that engage the external threads of the projectile nose.

4. The munition of claim 2, wherein the adapter forms a gas seal between an exterior and an interior of the munition.

5. The munition of claim 4, further comprising an initiator disposed one of in the projectile nose and adjacent an aft end of the explosive charge.

6. The munition of claim 5, wherein the initiator is a spitback initiator that is disposed adjacent the void defined by the liner.

7. The munition of claim 5, further comprising an obturating band disposed on the projectile body.

8. The munition of claim 2, wherein the munition is a shaped charge munition and the liner includes a portion that increases in diameter in a direction toward the fore end of the projectile body.

* * * * *